US005399057A

United States Patent [19]

Cunic

[11] Patent Number: 5,399,057

[45] Date of Patent: Mar. 21, 1995

[54] SELF-LOCKING LAGGING STRIP

[76] Inventor: Joseph M. Cunic, 1162 Admiral St., Pittsburgh, Pa. 15212

[21] Appl. No.: 69,110

[22] Filed: May 28, 1993

[51] Int. Cl.[6] ..... E02D 17/08

[52] U.S. Cl. ..... 405/285; 405/272; 405/279; 405/282; 52/764

[58] Field of Search ..... 256/12.5, 24; 52/474, 52/764; 49/464, 465; 405/272–276, 279, 282–285; 238/10 R, 10 A, 13, 310, 54, 60, 61, 72, 313, 349, 351

[56] References Cited

U.S. PATENT DOCUMENTS

| | | | |
|---|---|---|---|
| 638,922 | 12/1899 | Gregg | 238/61 |
| 1,093,023 | 4/1914 | Alta . | |
| 1,096,746 | 5/1914 | Parmeter | 238/313 X |
| 2,808,524 | 10/1957 | Sullivan | 52/764 X |
| 3,011,316 | 12/1961 | Wilson | 256/24 X |
| 3,015,375 | 1/1962 | Lickliter et al. . | |
| 3,120,376 | 2/1964 | Case | 256/24 |
| 3,420,065 | 1/1969 | Holl | 405/284 |
| 3,574,510 | 4/1971 | Herman . | |
| 3,656,268 | 4/1972 | Murati | 405/36 X |
| 3,748,808 | 7/1973 | Sheppard et al. | 52/665 |
| 3,770,245 | 11/1973 | Murdock | 256/24 |
| 3,786,607 | 1/1974 | Bartels | 52/474 |
| 4,154,062 | 5/1979 | Koehl | 405/282 |
| 4,773,200 | 9/1988 | Young | 52/484 |
| 4,907,389 | 3/1990 | Pettit | 52/668 |
| 4,946,099 | 8/1990 | Bratchell | 238/310 X |

FOREIGN PATENT DOCUMENTS

| | | | |
|---|---|---|---|
| 167114 | 1/1986 | European Pat. Off. | 405/282 |
| 1514715 | 6/1978 | United Kingdom | 405/272 |
| 2245614 | 1/1992 | United Kingdom | 256/24 |

*Primary Examiner*—Randolph A. Reese
*Assistant Examiner*—John A. Ricci
*Attorney, Agent, or Firm*—Armstrong, Westerman, Hattori, McLeland & Naughton

[57] ABSTRACT

A self-locking elongated lagging strip having a dovetail-shaped groove running along the length of the strip and in which groove there is mounted a slide fastener having a first, tongue portion of dovetail section slidable in the groove in the strip, and a second portion of generally rectangular shape disposed above the tongue portion and projecting beyond the tongue portion so as to engage a surface of a vertical beam to hold the strip against the beam pending placement of a backfill material.

4 Claims, 2 Drawing Sheets

SELF-LOCKING LAGGING STRIP

BACKGROUND

1. Field of the Invention

This invention relates to self-locking lagging strips for attachment to support members such as H beams which are used to provide support for retaining walls, for example in embankments along the sides of roadways.

2. Description of Related Art

In the construction of retaining walls for embankments along roadways, main support members in the form, for example, of steel beams of an H section, are driven vertically into the ground and retaining walls of some form are constructed using the H beams as support therefor. Sometimes steel studs are welded to the front of the vertical beams and wooden forms are put in place and a concrete wall is poured in the forms for providing a permanent retaining wall for holding in place a backfill, e.g. of soil, sand or gravel. In other instances, a simple wooden wall is installed in front of the vertical beams and held in place simply by driving nails in the wood and bending the nails around the beams.

SUMMARY OF THE INVENTION

This invention provides a self-locking elongated lagging strip having a dovetail-shaped groove running along the length of the strip and in which groove there is mounted a slide fastener having a first, tongue portion of dovetail section slidable in the groove in the strip, and a second portion of generally rectangular shape disposed above the first portion and projecting beyond the tongue portion so as to engage a surface of a vertical beam to hold the strip thereagainst pending placement of a backfill material.

DESCRIPTION OF PREFERRED EMBODIMENTS

Figure 1:
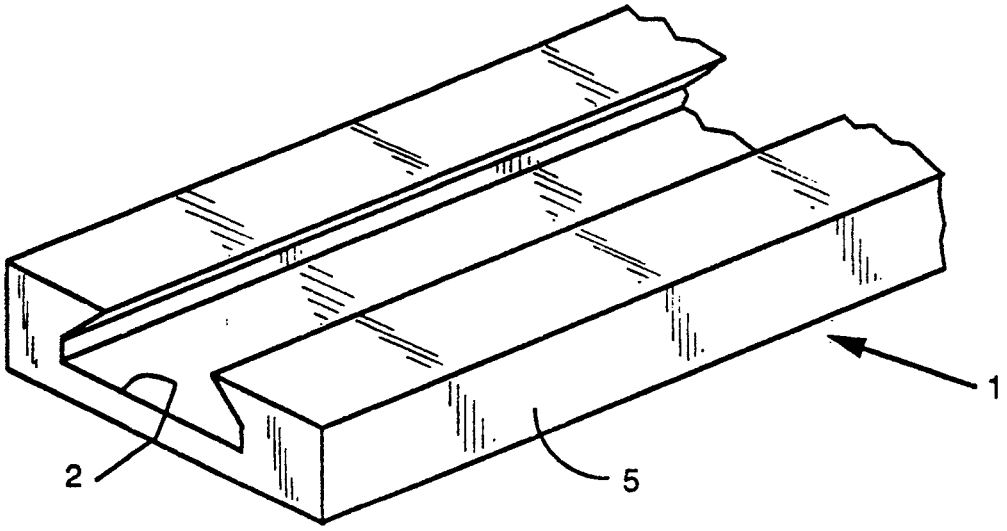
FIG. 1 is a perspective view of the lagging strip of the invention, showing the dovetail groove extending the length of the strip.
Figure 2:
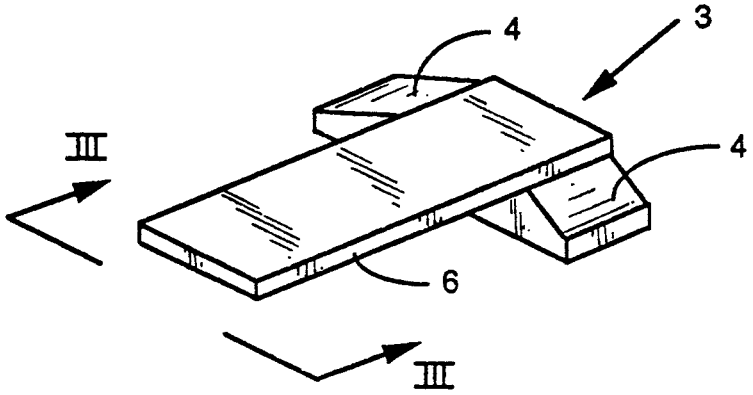
FIG. 2 is a perspective view of the slide fastener which is mountable by a tongue portion within the groove of the lagging strip and slidably movable therein.

In FIG. 1 there is shown an elongated lagging strip denoted generally by the numeral 1 comprising a body portion 5 which may be formed of a suitable plastic material such as polyvinyl chloride, polyethylene, polypropylene, etc., or of wood or other suitable material. The body portion 5 is provided with a groove 2 extending lengthwise of the strip along its centerline. Groove 2 may have a cross section in the form of the familiar "dovetail" joint or other polygonal or curved section which serves a tongue and groove locking function.

Figure 3:
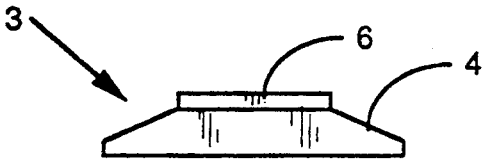
FIG. 3 is a vertical end view of the slide fastener.

A slide fastener denoted generally by the numeral 3 is illustrated in FIG. 3. Slide fastener 3 has a first, tongue portion 4 comprising a pair of "wings" extending laterally of the fastener and having a cross section adapted to fit and smoothly slide inside the groove 2 of the lagging strip 1. A second, locking portion 6 of the fastener 3 is disposed above the tongue 4 and projects therebeyond in one direction so that, when the tongue 4 of the slide fastener is mounted in groove 2 and disposed near an end thereof, portion 6 projects beyond the corresponding end of the strip 1 to serve a holding or locking function.

Figure 4:
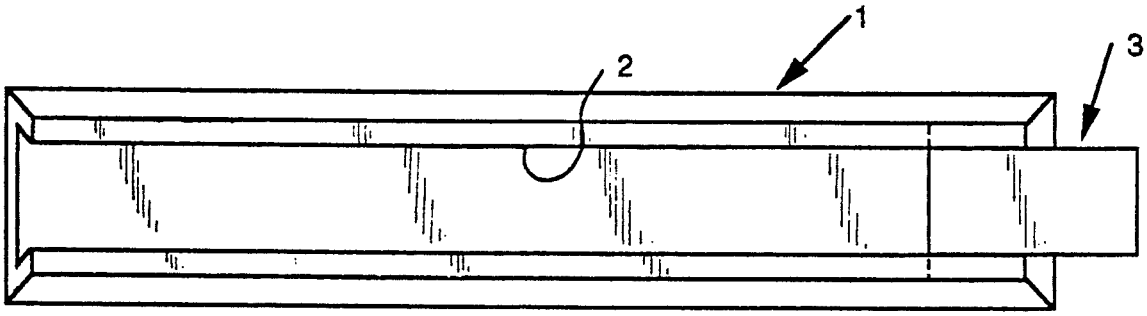
FIG. 4 is a top plan view of the lagging strip with one slide fastener mounted thereon.

FIG. 4 shows the lagging strip 1 with one slide element 3 in place near one end of the strip. In use of the invention, a slide element 3 is placed at each end of the Strip.

Figure 5:
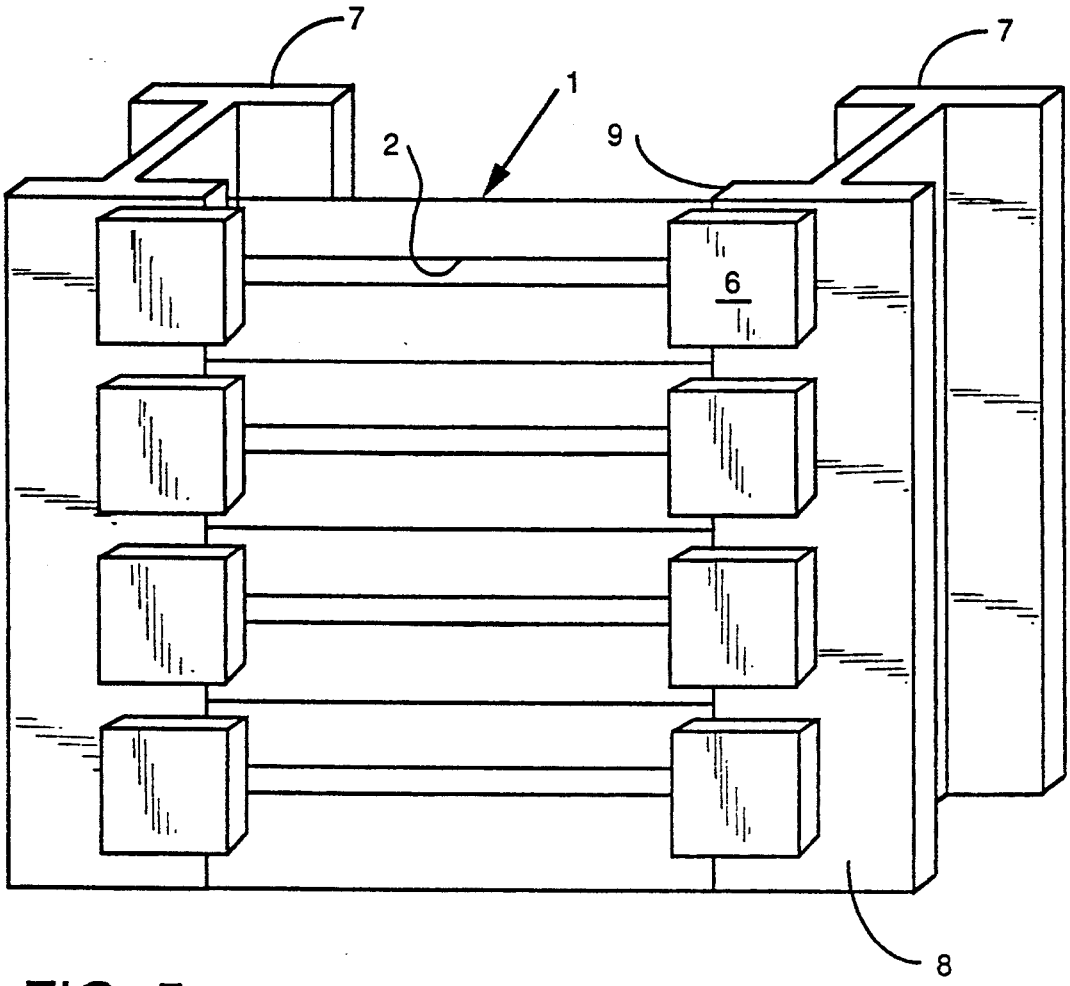
FIG. 5 is an elevational view of a pair of H beams with a plurality of the lagging strips of the invention mounted thereon.

Such use of the invention is illustrated in FIG. 5, in which a pair of vertically disposed H beams 7 are disposed in horizontally spaced apart relationship as in the construction of a retaining wall. A plurality of lagging strips 1 are disposed between the H beams, with the locking element 6 of the slide fasteners 3 at each end of the strip 1 being disposed adjacent one of the flat surfaces 8 of an H beam 7, with each end of the strip 1 being abutted against an edge 9 of the H beam. In the embodiment of the invention as illustrated in FIG. 5, the back side of the lagging strips seen by the observer would be backfilled with soil or other backfill material such that the lagging strips would serve to temporarily hold back the backfill, pending installation of a permanent retaining wall e.g. across the front face of the lagging strips.

The lagging strips of the invention can readily be used in the installation of other engineering constructions, such as foundations, etc. They also can be used in building supporting and curtain wall constructions and the like.

What is claimed is:

1. A self-locking lagging strip comprising an elongated body portion having a locking groove extending continuously lengthwise along a centerline thereof and opening at a top surface of the body portion and at the opposite ends of the body portion, said groove having a flat bottom of greater width than the opening at the top surface of the body portion and flat sides connecting the bottom of the groove with the top surface of the body portion, an elongated slide fastener comprising a tongue portion having a cross section extending normal to the length of the fastener of the same shape but slightly smaller than a similar cross section of the locking groove and slidably mounted within the locking groove, and a generally rectangular locking portion integral with and disposed above the tongue and extending beyond the tongue in a direction of movement of the fastener within and outwardly of the groove toward an end of the body portion and wherein a flat bottom surface of the locking portion lies substantially in the plane of the top surface of the body portion in a manner such that, when the fastener is positioned adjacent said one end of the body portion, the locking portion projects beyond said one end of the body portion and the flat bottom surface of the locking portion is adapted to lock the strip against a flat surface of a support member to which the strip is attached.

2. A lagging strip according to claim 1, wherein a slide fastener is mounted within the groove adjacent each end of the body portion of the strip.

3. A temporary retaining wall construction comprising at least one pair of vertically disposed support beams each having a flat surface facing in the direction of backfill to be disposed behind the wall, a plurality of elongated lagging strips vertically disposed one above another and extending between the at least one pair of support beams, each of said lagging strips comprising a body portion having a locking groove and a pair of fasteners each having a tongue disposed in said groove and slidable along the length of the groove and a locking portion extending beyond an end of the lagging strip and disposed adjacent the flat surface of a corresponding support beam.

4. A method of constructing a temporary retaining wall, comprising vertically disposing a plurality of horizontally spaced apart support beams each having a flat surface facing in the direction of backfill to be disposed behind the wall, disposing between each pair of support beams a plurality of lagging strips each of which comprises a body portion having a locking groove and a pair of slide fasteners each having a tongue disposed in said groove and slidable therein along the length of the groove and a locking portion extending beyond an end of the body portion of the lagging strip and disposed adjacent the flat surface of a corresponding support beam, and disposing a backfilling material against the beams and lagging strips whereby the locking portions of the slide fasteners are pressed and held against corresponding flat surfaces of the support beams.

* * * * *